US006354335B1

(12) United States Patent
Taipale et al.

(10) Patent No.: US 6,354,335 B1
(45) Date of Patent: Mar. 12, 2002

(54) PAPER MACHINE FABRIC

(75) Inventors: Seppo Taipale, Siilinjärvi; Terttu Turpeinen, Juankoski; Tania Rautio, Kuopio; Pekka Kortelainen, Juankoski, all of (FI)

(73) Assignee: Tamfelt Oyj ABP, Tampere (FI)

( * ) Notice: Subject to any disclaimer, the term of this patent is extended or adjusted under 35 U.S.C. 154(b) by 0 days.

(21) Appl. No.: 09/852,734

(22) Filed: May 11, 2001

(30) Foreign Application Priority Data

Feb. 22, 2001 (FI) ..... 20010348

(51) Int. Cl.[7] ..... D03D 11/00; D03D 13/00
(52) U.S. Cl. ..... 139/383 A
(58) Field of Search ..... 139/383 A

(56) References Cited

U.S. PATENT DOCUMENTS

| | | | | |
|---|---|---|---|---|
| 4,501,303 A | | 2/1985 | Österberg | |
| 4,987,929 A | * | 1/1991 | Wilson | 139/383 A |
| 5,482,567 A | * | 1/1996 | Barreto | 139/383 A |
| 5,826,627 A | | 10/1998 | Seabrook et al. | |
| 5,967,195 A | | 10/1999 | Ward | |
| 6,202,705 B1 | * | 3/2001 | Johnson et al. | 139/383 A |
| 6,240,973 B1 | * | 6/2001 | Stone et al. | 139/383 A |

FOREIGN PATENT DOCUMENTS

| | | |
|---|---|---|
| EP | 0 414 148 A3 | 2/1991 |
| EP | 0 408 849 A3 | 3/1992 |
| FI | 854974 | 5/1989 |

* cited by examiner

*Primary Examiner*—Andy Falik
(74) *Attorney, Agent, or Firm*—McDermott, Will & Emery

(57) ABSTRACT

A paper machine fabric comprising at least two separate layers formed using at least two separate yarn systems: a yarn system forming the paper side and comprising machine direction and cross machine direction yarns and a yarn system forming the machine side and comprising machine direction and cross machine direction yarns, the yarn systems being arranged to form independent structures in the machine and cross machine directions of the fabric and the structures being bound together by means of binder yarns, a binder yarn being arranged to form part of the weave of a layer on the paper side surface and arranged to be interwoven with a layer of the machine side by being interwoven under at least one yarn in the machine side layer. The yarn system forming the paper side further comprises a substitute yarn provided with a binder yarn woven on both sides thereof. On the paper side, the substitute yarn is arranged to replenish the two yam paths formed by the above-mentioned two binder yarns at points where the above-mentioned two binder yarns are interwoven with the machine side.

18 Claims, 3 Drawing Sheets

PAPER MACHINE FABRIC

Figure 1:
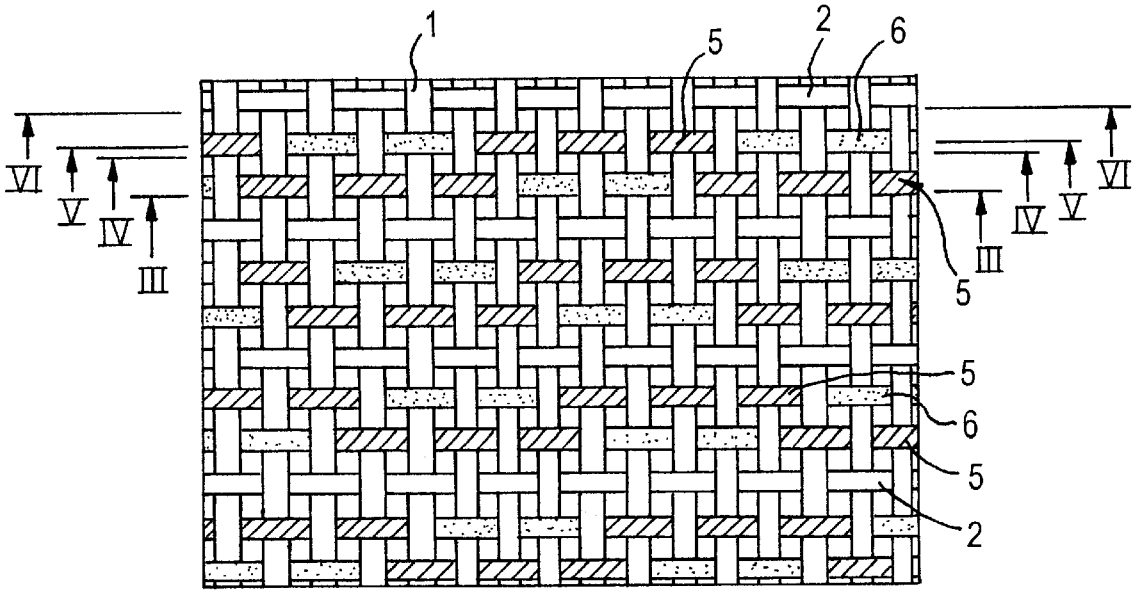

The invention relates to a paper machine fabric comprising at least two separate layers formed using at least two separate yarn systems: a yarn system forming the paper side and comprising machine direction and cross machine direction yarns and a yarn system forming the machine side and comprising machine direction and cross machine direction yarns, the yarn systems being arranged to form independent structures in the machine and cross machine directions of the fabric and the structures being bound together by means of binder yarns, a binder yarn being arranged to form part of the weave of a layer on the paper side surface and arranged to be interwoven with a layer of the machine side by being interwoven under at least one yarn in the machine side layer.

Conventional triple layer paper machine fabrics comprise two separate layers: a paper side layer and a machine side layer. The paper side layer and the machine side layer are interconnected mainly by means of a binder weft which serves as a binder yarn. Binding with a binder yarn usually takes place at every fourth top and bottom yarn pairs, i.e. relatively seldom. On the top side, the binding takes place over one top warp and on the bottom side, under one bottom warp. The binder yarn does not contribute to the forming of the paper side surface, but only to the binding of the layers. Consequently, the paper side layers and the machine side layers are not interconnected tightly enough. This causes "innerside wear" in the fabric. Innerside wear refers to the wear caused by interlayer abrasion.

As a result of the interlayer wear mentioned above, the yarns wear down at the cross points of the binder yarn and warp yarns and later, as the fabric becomes looser, the yarns increasingly start moving with respect to each other, causing the intrinsic structures of the paper side and the machine side to wear down. The innerside wear of the fabric causes the binder yarn to start making markings on the surface of the paper because the fabric has lost its original thickness on its inner side while the binder yarn, in turn, has retained its original length. Highly increased innerside wear may also cause the layers to become detached from each other.

The binder yarn draws a warp yarn bound on the paper side slightly inwards. This dimpling causes marking. The binder yarn also forms an additional float stitch at this point in the structure. The fabric is thus denser at this point, and the water being removed from the paper web is not allowed to pass evenly through the fabric, which results in marking.

In a conventional triple layer fabric, the binder yarn on the paper side is preferably positioned slightly below the surface in order for the binder yarn not to cause marking. In order for the marking caused by the binding points to be as slight as possible, the binder yarn should be thinner than the top weft. Since the binder yarn cannot really be made thinner than it currently is (current diameter e.g. 0.13 mm), the top wefts cannot be made thinner than they currently are either (current diameter e.g. 0.15 mm), which means that the top weft density cannot be increased without decreasing permeability; consequently, paper fiber support remains low, particularly with high permeabilities.

Structures bound with binder yarn pairs are also known in the field. U.S. Patent Specifications U.S. Pat. Nos. 4,501,303, 5,967,195 and 5,826,627, for instance, describe techniques employed for binding structures using a binder yarn pair. In the structures bound using a binder yarn pair, instead of the binder yarn, it is the binder yarn pair which is responsible for binding the layers. A binder yarn pair comprises two adjacent binder yarns, one of the binder yarns establishing the paper side surface weave and the other simultaneously binding a paper side layer and a machine side layer together under one machine side bottom warp and vice versa. The zigzags of the binder yarn pair on the paper side surface establish a weft path similar to the top weft. The yarns of the binder yarn pair cross at a point where one binder yarn descends in the fabric from the paper side in order to bind the layers, while the other binder ascends in the fabric to form the surface of the paper side. This intersection prevents the binder yarns from moving into a straight line, which means that a paper side weft path formed by a binder yarn pair is not as straight as a weft path formed by an actual top weft.

The top weft positioned at both sides of the intersection presses the top warp yarns at the intersection downwards and, simultaneously, both yarns of the binder yarn pair descend into the fabric, not supporting the top warp yarns from below. Consequently, the intersections remain on a lower plane than the surface, which may cause marking. This is disclosed in U.S. Patent Specification U.S. Pat. No. 5,967,195.

In the structures bound using a binder yarn pair, the binder yarn pair comprises two yarns whereas one yarn constitutes the top weft. Typically, the top weft and the binder yarns have the same diameter. This means that the water drainage capacity at the binder yarn pair differs from that at the top weft, which, in the worst case, may appear in the form of marking in the paper. In order to ensure the water drainage capacity, the fabric must usually be coarser.

In the most common structures bound using a binder yarn pair, a bottom weft is provided at the top weft but no bottom weft is provided at the binder yarn pair, so the number of machine side bottom wefts is half the number of paper side weft paths, which means that there is little material to be worn down on the machine side, which results in poor wear resistance. If high wear resistance is to be achieved, density on the machine side should be the same, or almost the same, as on the paper side. If the machine side density and the paper side density are the same, weft density must be lowered in order to ensure the water drainage capacity, which results in poorer paper fiber support.

In the most common structures bound using a binder yarn pair, the yarns of the binder yarn pair are interwoven with every other top warp and the top weft is interwoven with every other top warp. Hence, every other top warp is interwoven in a different manner, remaining on a slightly different plane with respect to the surface. In paper grades most susceptible to marking this may appear in the form of marking in the warp direction.

An object of the invention is to provide a paper machine fabric to enable drawbacks of the prior art to be alleviated. This is achieved by a paper machine fabric of the invention, which is characterized in that the yarn system forming the paper side comprises a substitute yarn provided with a binder yarn woven on both sides thereof, and that on the paper side the substitute yarn is arranged to replenish the two yarn paths formed by the above-mentioned two binder yarns at points where the above-mentioned two binder yarns are interwoven with the machine side.

An advantage of the invention is e.g. the fact that the binder yarn not only binds the layers together but, in addition to the binding, the binder yarns also contributes to the forming of the paper side surface by being interwoven with several top warps, which enables binder yarns to be woven more densely than in the conventional triple layer fabrics. Consequently, the binding is tight, which prevents the layers from moving against each other. When the binder yarn contributes to the forming of the paper side surface, the marking caused by the binder yarn typical of the conventional triple layer fabrics is eliminated. The same property also enables excellent paper fiber support to be achieved in the structure. This advantage is important particularly with higher permeabilities where the number of cross machine direction yarns must be reduced in order to achieve sufficient permeability.

In the structures bound using a binder yarn pair, the top warp positioned at the intersection of the binder yarns is poorly supported from below, which means that at this point the top warp remains on a lower plane compared to the surrounding structure, the particular point causing marking in the paper. In the structure of the invention, on the paper side at the point where the binder yarn descends to the machine side in order to bind, the substitute weft forms a highly supportive bridge structure to lift the particular point up to the same plane as the surrounding structure, which results in no marking.

Since the fabric of the invention comprises no binder yarn pairs to tighten the structure, the bottom side weft density can be increased without the fabric becoming too dense, thus enabling more material to be provided on the machine side and more wear resistance to be achieved for the fabric.

Figure 2:
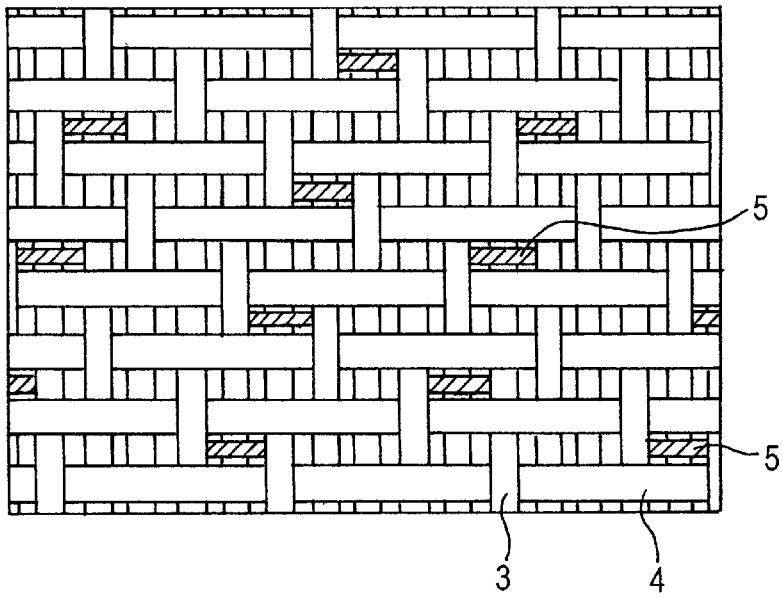
Figure 3:
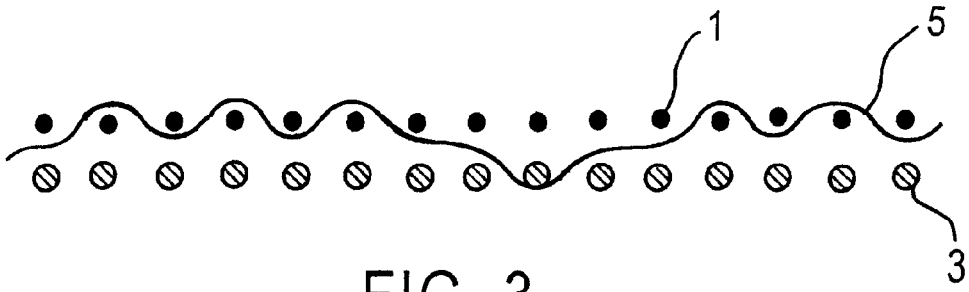
Figure 4:
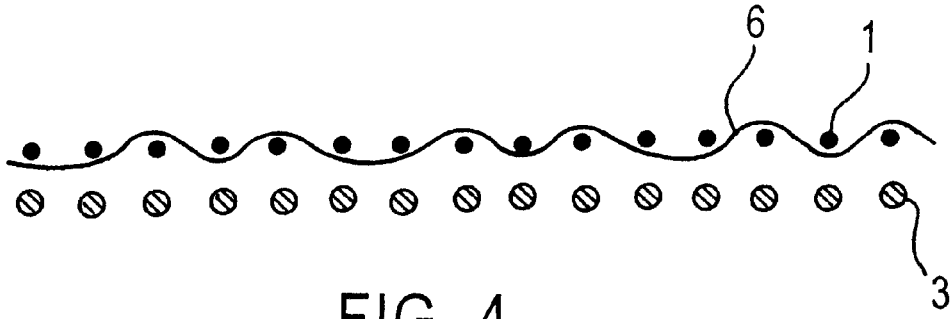
Figure 5:
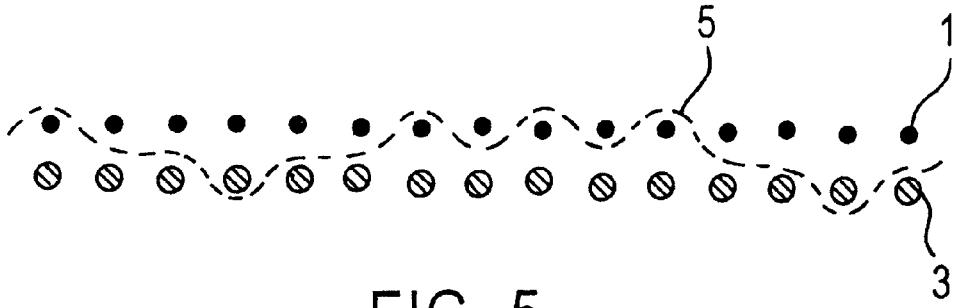
Figure 6:
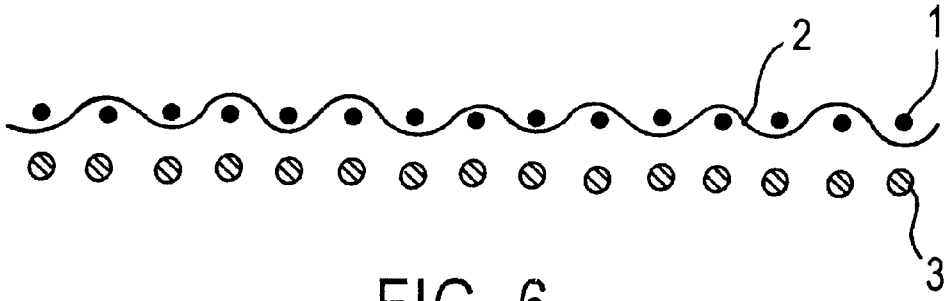

In the following, the invention will be explained in closer detail by means of the examples disclosed in the accompanying drawing, in which FIG. 1 is a view of a paper machine fabric of the invention as seen from the paper side, FIG. 2 is a view of the paper machine fabric according to FIG. 1 as seen from the machine side, FIG. 3 is a view as seen according to arrows III—III of FIG. 1, FIG. 4 is a view as seen according to arrows IV—IV of FIG. 1, FIG. 5 is a view as seen according to arrows V—V of FIG. 1, FIG. 6 is a view as seen according to arrows VI to VI of FIG. 1, and FIGS. 7 to 9 are views of another embodiment of the invention as seen at different yarns, showing the structure in a similar manner to that in FIGS. 3 to 6.

The figures show an embodiment of the paper machine fabric of the invention. The paper machine fabric of the invention is provided with at least two machine direction yarn systems, e.g. a top warp system and a bottom warp system and at least two cross machine yarn systems, e.g. a top weft system and a bottom weft system. The fabric structure further comprises a binder yarn system.

The top warp system and the top weft system form a layer forming the paper side, and, similarly, the bottom warp system and the bottom weft system form a layer forming the machine side. In the figures, top warps are designated by reference number 1 and top wefts by reference number 2. Bottom warps are designated by reference number 3 and bottom wefts by reference number 4 in the figures. The layer forming the paper side and the layer forming the machine side are bound together using a binder yarn system. In the figures, binder yarns are designated by reference number 5. On the paper side surface, a binder yarn 5 forms part of the weave of the layer, and enters and exits the machine side to bind the layers together by becoming interwoven under at least one bottom warp 3.

According to the idea underlying the invention, the yarn system forming the paper side comprises a substitute yarn 6, in the example of the figures a substitute weft 6, a binder yarn 5 being woven on both sides thereof. On the paper side, the substitute yarn 6 is arranged to replenish the two yarn paths formed by the above-mentioned two binder yarns 5, in the example of the figures a weft path, at points where the above-mentioned two binder yarns are interwoven with the machine side.

On the paper side, the above-mentioned substitute weft 6 thus replenishes the weft paths formed by the binder yarn woven on both sides of the substitute weft at the points where the binder yarn 5 is interwoven with the machine side. The binder yarns 5 and the substitute weft 6 woven therebetween thus form two weft paths on the paper side surface that are similar to the weft path of an actual top weft 2. Consequently, the two binder yarns 5 and the substitute weft 6 woven therebetween form two weft paths on the paper side surface. This is clearly shown in FIG. 1. The travel paths in the fabric of the binder yarns 5 adjacent to the substitute weft 6 may be similar or different. The number of binding points of the substitute yarn 6 on the paper side surface of the fabric may be the same as or it may differ from the number of binding points of the adjacent binder yarn 5 on the paper side surface.

The top weft system comprises top wefts of at least one kind. If there is only one top weft, it is a substitute weft 6. The example of the figures, however, shows an embodiment wherein the top weft system comprises both ordinary top wefts 2 and substitute wefts 6. The binding of the top weft 2 may be similar to or different from that of the weft paths formed jointly by the binder yarns 5 and the substitute yarn 6 on the paper side surface.

On the paper side surface of the embodiment of the invention shown in the figures, the top weft 2, binder yarn 5, substitute weft 6 and the binder yarn 5 constitute a group of yarns that regularly and repeatedly runs through the fabric. The top weft 2 is bound using a plain weave. The binder yarn 5 is bound on the paper side surface using a plain weave, descending to bind the layers together by being interwoven under one bottom warp 3, as shown e.g. in FIGS. 3 and 5. On the paper side, the substitute weft 6 replenishes the weft path formed by the binder yarn 5 while the binder yarn 5 is interwoven with the machine side. As stated above, the two binder yarns 5 and the substitute weft 6 form two plain weave weft paths on the paper side surface. In this example, the weave of the bottom wefts is a 5-shed satin. The weave of the binder yarns in this example is a 10-shed one.

Since the substitute weft 6 is only interwoven with the paper side layer, it does not form, jointly with the binder yarn 5, a similar intersection to that formed by the binder yarn pairs in the structures bound using a binder yarn pair. Consequently, the substitute weft 6 easily sets in appropriate places in order to replenish the weft paths formed by the binder yarns 5 positioned on its both sides and the substitute weft 6 itself. Thanks to the structure, the weft paths formed by the binder yarns 5 and the substitute weft 6 are straight. When all weft paths are straight, openings that appear in the paper side surface can be made as equal in size as possible. This guarantees good and uniform support for the paper fibers on the paper side surface of the entire fabric. A further advantage of the structure is that the capillaries of the water drainage system are uniform in size and shape, which enables controlled and even water drainage to be achieved. Thanks to these structural properties, the paper is provided with a good forming and even surfaces.

| PROPERTY | Structure of the invention | Conventional triple layer fabric | Structure bound using a binder yarn pair |
|---|---|---|---|
| MD YARNS: ϕ/density | | | |
| Top warp (mm/yarns/cm) | 0.15/34 | 0.15/34 | 0.15/34 |
| Bottom warp (mm/yarns/cm) | 0.19/34 | 0.19/34 | 0.19/34 |
| CMD YARNS: ϕ/density | | | |
| Top weft (mm(yarns/cm) | 0.13/12.6 | 0.15/26.5 | 0.13/19.3 |
| Substitute weft (mm/yarns/cm) | 0.13/12.6 | — | — |
| Binder weft (mm/yarns/cm) | 0.13/12.6 | 0.13/7 | 0.13/19.3 |
| Bottom weft (mm/yarns/cm) | 0.22/25.2 | 0.22/26.5 | 0.22/19.3 |
| MD yarn density (yarns/cm) | 68 | 68 | 68 |
| CMD yarn density (yarns/cm) | 63 | 53 | 58 |
| S-index | 72 | 61 | 73 |
| FSI | 185 | 147 | 188 |
| Air Permeability ($m^3/m^2/h$) | 5000 | 5000 | 5000 |
| Wear margin (mm) | 0.20 | 0.20 | 0.20 |
| Paper side weave | plain weave | plain weave | plain weave |
| Machine side weave | 5-shed | 5-shed | 5-shed |

The accompanying table shows the solution of the invention, a conventional triple layer fabric structure and a structure bound using a binder yarn pair being compared. The structure of the invention combines the good properties of the conventional triple layer fabric structure and the structure bound using a binder yam pair. The structure of the invention enables as high wear resistance as the conventional triple layer fabric structure and clearly higher wear resistance than the structure bound using a binder yarn pair to be achieved. This is indicated by the bottom weft density. Fiber Support Index (FSI) describes the level of support provided by the fabric for the paper fibers. S-index indicates the number of paper side yarns per square centimeter. The fiber support achieved by the structure of the invention is as good as the fiber support achieved by the structure bound using a binder yarn pair, and it is clearly better than that achieved by the conventional triple layer fabric structure.

In the structure of the invention, the binder yarns 5 and the top wefts 2 are interwoven with each top warp 1, unlike in the most common structures bound using a binder yarn pair where the binder yarns are interwoven with every other top warp and the top wefts are interwoven with every other top warp. In the structure of the invention, thanks to the way in which the binding is carried out, all top warps 1 are positioned on the same plane with respect to the surface, and no marking in the warp direction occurs.

The structure of the invention also provides higher wear resistance than the most common structures bound using a binder yarn pair and provided with the same permeability. For example, if ten weft paths are to be provided on the paper side surface, the structure of the invention requires thirteen yarns while the structure bound using binder yarn pairs requires fifteen yarns. In the structure of the invention, this advantage enables more weft yarns to be woven on the bottom side than in the structures bound using a binder yarn pair and provided with similar permeability, i.e. the bottom side can be provided with more yarn material to be worn down, which means higher wear resistance.

Figure 7:
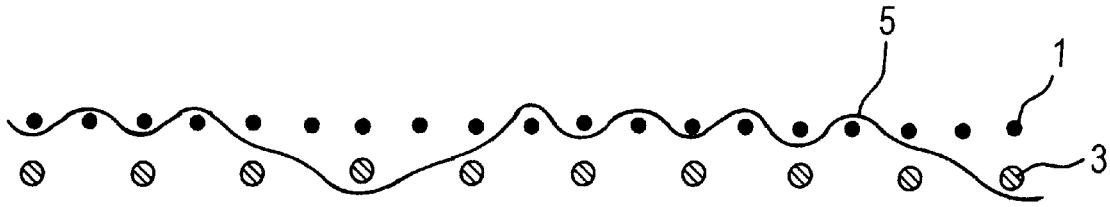
Figure 8:
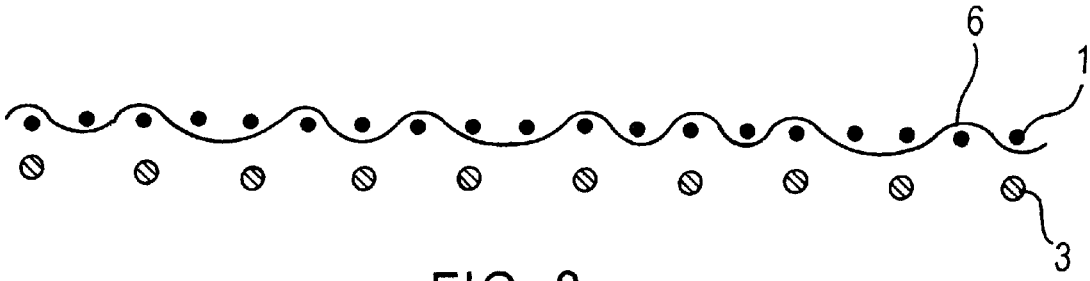
Figure 9:
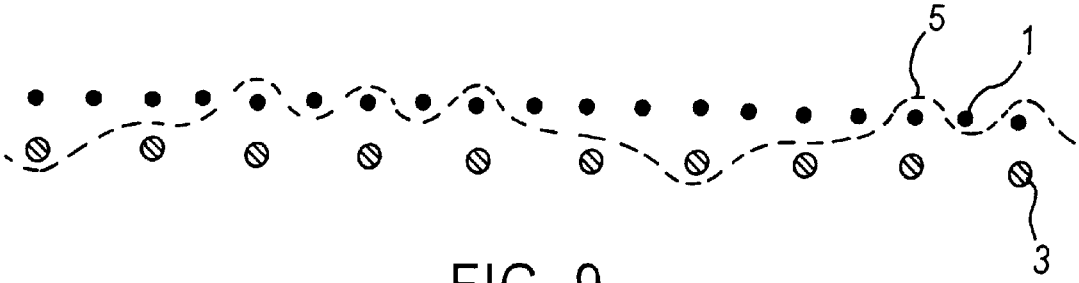

FIGS. 7 to 9 schematically show another embodiment of the solution of the invention. In FIGS. 7 to 9, the structure is for the most part shown in the same manner as the previous embodiment in FIGS. 3 to 6. In FIGS. 7 to 9, the same numbers have the same significance to indicate corresponding features as in FIGS. 1 to 6. In the embodiments of FIGS. 7 to 9, the zigzag of the binder yarns 5 differs from the application of FIGS. 1 to 6 and, furthermore, in the embodiment of FIGS. 7 to 9, one bottom warp 3 corresponds to two top warps 1. In the embodiment of FIGS. 7 to 9, the travel paths of the binder yarns adjacent to the substitute weft 6 are different.

The embodiments disclosed above are by no means intended to restrict the invention, but the invention can be modified freely within the scope of the claims. It is thus obvious that the paper machine fabric of the invention or the details thereof do not necessarily have to be identical to those shown in the figures but other solutions are also feasible. The separate layers can be formed very freely, i.e. such that the number of yarn systems may vary, the essential point being that there are at least two warp systems: a bottom warp system and a top warp system. Similarly, the number of weft systems may also vary, the essential point being that there are at least two weft systems: a top weft system and a bottom weft system etc. The structure of the invention described above is a triple layer one, but other multilayer structures are feasible within the scope of the invention. On the paper side surface, instead of the plain weave, also other weaves, such as satin or twill weaves, can be used. The weaves of the bottom wefts and the binder yarns may also vary freely within the basic idea of the invention. It is further to be noted that the basic idea of the invention enables structures that completely lack top wefts, i.e. a structure wherein the paper side is provided with substitute wefts only. On the other hand, it is also perfectly feasible to form structures wherein the number of top wefts is larger than the number of substitute wefts, i.e. the number of top wefts may vary, being e.g. 0, 1, 2, 3, etc. The number of bottom wefts may differ from the total number of top wefts and substitute wefts. The ratio of top warps to bottom warps is usually 1:1, but it may also be a different one. The diameters of the yarns may be e.g. as follows: top warp 0.12–0.15, bottom warp 0.17–0.21, substitute weft 0.10–0.16, top weft 0.10–0.16, binder yarn 0.10–0.16, and bottom weft 0.17–0.30. The above values are given in millimeters. The diameters of the yarns may, however, be other than what has been disclosed above. The solution set forth above employs polyester or polyamide yarns with circular cross-sections. Other possible yarn materials include e.g. polyethylene naphthalate (PEN) and polyphenylene sulfide (PPS). The cross-section of the yarns may also be flat or oval. The properties of the yarns affect the properties of the fabric. For example, by choosing a substitute weft with a low bending stiffness, the paper side binding points of the substitute weft easily set in appropriate places in the path formed by the binder yarn and the substitute weft, which means that the path is as straight as possible. The bending stiffnesses of the substitute weft and the top wefts may be equal or unequal.

In the structure described above, the binding takes place in the weft direction. This is not the only solution, however. Structures wherein the binding takes place in the warp direction are also feasible, in which case the structure comprises at least a binder warp, substitute warp, bottom warp, top weft and bottom weft. The substitute yarn can thus be either a substitute weft or a substitute warp.

What is claimed is:

1. A paper machine fabric comprising at least two separate layers formed using at least two separate yarn systems: a yarn system forming the paper side and comprising machine direction and cross machine direction yarns and a yarn system forming the machine side and comprising machine direction and cross machine direction yarns, the yarn systems being arranged to form independent structures in the machine and cross machine directions of the fabric and the structures being bound together by means of binder yams, a binder yarn being arranged to form part of the weave of a layer on the paper side surface and arranged to be interwoven with a layer of the machine side by being interwoven under at least one yarn in the machine side layer, the yarn system forming the paper side further comprising a substitute yarn provided with a binder yarn woven on both sides thereof, and on the paper side the substitute yarn being arranged to replenish the two yarn paths formed by the above-mentioned two binder yarns at points where the above-mentioned two binder yarns are interwoven with the machine side.

2. A paper machine fabric as claimed in claim 1, wherein the substitute yarn is a substitute weft and the binder yarn is a binder weft.

3. A paper machine fabric as claimed in claim 1, wherein the substitute yarn is a substitute warp and the binder yarn is a binder warp.

4. A paper machine fabric as claimed in claim 3, wherein in addition to the substitute warp, the paper side surface is provided with at least one top warp.

5. A paper machine fabric as claimed in claim 2, wherein in addition to the substitute weft, the paper side surface is provided with at least one top weft.

6. A paper machine fabric as claimed in claim 5, wherein the binding of the top weft is similar to that of the weft paths formed jointly by the binder yarns and the substitute weft on the paper side surface.

7. A paper machine fabric as claimed in claim 5, wherein the binding of the top weft is different from that of the weft paths formed jointly by the binder yarns and the substitute weft on the paper side surface.

8. A paper machine fabric as claimed in claim 5, wherein the number of substitute wefts equals the number of top wefts, and the number of bottom wefts equals the total number of top wefts and substitute wefts.

9. A paper machine fabric as claimed in claim 8, wherein the weft path formed by the substitute weft and the binder yarns is arranged to comprise three binding points for the binder yarns and two binding points for the substitute weft.

10. A paper machine fabric as claimed in claim 9, wherein the binder yarns are interwoven under one bottom weft using a 10-shed weave and the bottom wefts are interwoven with the bottom warps using a 5-shed satin weave.

11. A paper machine fabric as claimed in claim 2, wherein in addition to the substitute weft, the paper side surface is provided with one top weft.

12. A paper machine fabric as claimed in claim 5, wherein the bending stiffnesses of the substitute weft and the top weft are equal.

13. A paper machine fabric as claimed in claim 5, wherein the bending stiffnesses of the substitute weft and the top weft are unequal.

14. A paper machine fabric as claimed in claim 1, wherein the travel paths in the fabric of the binder yarns adjacent to the substitute yarn are similar.

15. A paper machine fabric as claimed in claim 1, wherein the travel paths in the fabric of the binder yarns adjacent to the substitute yarn are different.

16. A paper machine fabric as claimed in claim 14, wherein the binder yarn comprises three binding points on the paper side surface.

17. A paper machine fabric as claimed in claim 1, wherein the paper side surface is provided with plain weave yarn paths.

18. A paper machine fabric as claimed in claim 1, wherein the number of binding points of the substitute yarn on the paper side surface is similar to or different from the number of binding points of an adjacent binder yarn on the paper side surface.

* * * * *